US006739712B2

(12) United States Patent
Kim

(10) Patent No.: US 6,739,712 B2
(45) Date of Patent: May 25, 2004

(54) INK CARTRIDGE WITH PRESSURE-CONTROLLING MODULE

(75) Inventor: Jeong-seon Kim, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 74 days.

(21) Appl. No.: 10/309,343

(22) Filed: Dec. 4, 2002

(65) Prior Publication Data

US 2003/0122907 A1 Jul. 3, 2003

(30) Foreign Application Priority Data

Dec. 4, 2001 (KR) ..... 2001-76232

(51) Int. Cl.[7] ..... B41J 2/175
(52) U.S. Cl. ..... 347/87; 347/86
(58) Field of Search ..... 347/84, 85, 86, 347/87; 221/1

(56) References Cited

U.S. PATENT DOCUMENTS

| | | | | | |
|---|---|---|---|---|---|
| 4,253,103 | A | * | 2/1981 | Heinzl et al. | 347/86 |
| 4,604,633 | A | * | 8/1986 | Kimura et al. | 347/7 |
| 5,409,134 | A | * | 4/1995 | Cowger et al. | 222/1 |
| 5,453,772 | A | * | 9/1995 | Aono et al. | 347/87 |
| 6,186,620 | B1 | * | 2/2001 | Hsieh et al. | 347/84 |
| 6,213,598 | B1 | * | 4/2001 | Hou et al. | 347/86 |
| 6,450,630 | B2 | * | 9/2002 | Kanaya et al. | 347/86 |

FOREIGN PATENT DOCUMENTS

| | | | | |
|---|---|---|---|---|
| JP | 2003-063030 | * | 3/2003 | B41J/2/175 |
| KR | 1990-009287 | | 12/1989 | |
| KR | 1998-13367 | | 6/1998 | |
| KR | 11-240171 | | 9/1999 | |
| KR | 2000-40186 | | 7/2000 | |

* cited by examiner

*Primary Examiner*—Anh T. N. Vo
(74) *Attorney, Agent, or Firm*—Staas & Halsey LLP

(57) ABSTRACT

An ink cartridge with a pressure-controlling module. The ink cartridge includes an ink reservoir in which ink is stored, a printhead through which ink from the ink reservoir is ejected onto a printing medium in a droplet shape, and a pressure-controlling module which is placed in the ink reservoir, by which the ink reservoir is maintained at a predetermined range of negative pressure, and in which a buffer volume to accommodate a rapid volume expansion of the ink reservoir is prepared. The pressure-controlling module includes a body having one opened side, which communicates with the ink reservoir, a guide plate which is placed vertically in the body and moves horizontally according to pressure variations of the ink reservoir such that the ink reservoir is maintained at the predetermined range of negative pressure, a flexible wall through which the guide plate and the opened side are connected to be sealed and which forms a variable wall depending on the movement of the guide plate, a spring which connects the guide plate to a side facing the opened side, and a vent hole to communicate a space, which is separate form the ink reservoir by the flexible wall, with ambient air.

26 Claims, 5 Drawing Sheets

INK CARTRIDGE WITH PRESSURE-CONTROLLING MODULE

CROSS-REFERENCE TO RELATED APPLICATIONS

This application claims the benefit of Korean Application No. 2001-76232, filed Dec. 4, 2001, in the Korean Intellectual Property Office, the disclosure of which is incorporated herein by reference.

BACKGROUND OF THE INVENTION

1. Field of the Invention

The present invention relates to an ink cartridge with a pressure-controlling module, and more particularly, to an ink cartridge with a pressure-controlling module which serves as a buffer to absorb a rapid volume increase in an ink reservoir and controls a negative pressure inside the ink cartridge caused by the use of ink.

2. Description of the Related Art

An ink cartridge used in an ink-jet printer stores ink, ejects ink droplets through a printhead and prints a predetermined color image on a printing medium. FIG. 1 is a cross-sectional view of an ink cartridge disclosed in U.S. Pat. No. 5,409,134. Referring to FIG. 1, a lid 2 is coupled to an ink reservoir 1 of the ink cartridge. A spring 3 and a flexible bag 4 having one side contacting the spring 3 are embedded in the ink reservoir 1. The flexible bag 4 is connected to a communication hole 5 formed in the lid 2.

In the ink cartridge having the above structure, ink is filled in a negative pressure state through a port (not shown). Due to the negative pressure inside the cartridge, ejection of ink through a printhead (not shown) is prevented when the printhead is not used.

As ink is used, the pressure of the ink reservoir 1 decreases, and thus the negative pressure increases. Further, the flexible bag 4 expands so that the volume of the ink reservoir 1 decreases and the ink reservoir 1 is maintained under a predetermined range of negative pressure. Thus, this provides for ink to be continuously ejected through the printhead from the ink reservoir 1. If the atmospheric pressure greatly decreases (for example, if the ink cartridge is transferred by airplane), the flexible bag 4 contracts such that the volume of the ink reservoir 1 increases, the ink reservoir 1 is maintained under the predetermined range of negative pressure and ejection of ink through the printhead is prevented.

However, the conventional ink cartridge has a complicated structure, and the volume of the flexible bag 4 which serves as a buffer is large. Thus, the ink cartridge with the flexible bag 4 is not suitable for a small ink cartridge, in particular, a small color ink cartridge.

SUMMARY OF THE INVENTION

Accordingly, it is an object of the present invention to provide an ink cartridge with a pressure-controlling module having a compact structure.

Additional objects and advantages of the invention will be set forth in part in the description which follows and, in part, will be obvious from the description, or may be learned by practice of the invention.

The foregoing and/or other objects of the present invention are achieved by providing an ink cartridge with a pressure-controlling module. The ink cartridge includes an ink reservoir in which ink is stored, a printhead through which ink from the ink reservoir is ejected onto a printing medium in a droplet shape, and a pressure-controlling module which is placed in the ink reservoir, by which the ink reservoir is maintained at a predetermined range of negative pressure, and in which a buffer volume to accommodate a rapid volume expansion of the ink reservoir is prepared. The pressure-controlling module includes a body having one opened side, which communicates with the ink reservoir, a guide plate which is placed vertically in the body and moves horizontally according to the pressure variations of the ink reservoir such that the ink reservoir is maintained at a predetermined range of negative pressure, a flexible wall through which the guide plate and the opened side are connected to be sealed and which forms a variable wall depending on the movement of the guide plate, a spring which connects the guide plate to a side facing the opened side, and a vent hole to communicate a space, which is separated from the ink reservoir by the flexible wall, with ambient air.

The foregoing and/or other objects of the present invention may also be achieved by providing a color ink cartridge with a pressure-controlling module which comprises a plurality of ink reservoirs each of which is filled with a predetermined color of ink. Each ink reservoir includes a printhead through which ink of the ink reservoir is ejected onto a printing medium in a droplet shape, and a pressure-controlling module for each ink reservoir which is placed in the ink reservoir, by which the ink reservoir is maintained at a predetermined range of negative pressure, and in which a buffer volume to accommodate a rapid volume expansion of the ink reservoir is prepared. Each pressure-controlling module includes a body having one opened side, which communicates with the ink reservoir, a guide plate which is placed vertically in the body and moves horizontally according to the pressure variations of the ink reservoir such that the ink reservoir is maintained at a predetermined range of negative pressure, a flexible wall through which the guide plate and the opened side are connected to be sealed and which forms a variable wall depending on the movement of the guide plate, a spring which connects the guide plate to a side facing the opened side, and a vent hole to communicate a space, which is separated from the ink reservoir by the flexible wall, with ambient air.

BRIEF DESCRIPTION OF THE DRAWINGS

These and other objects and advantages of the invention will become apparent and more readily appreciated from the following description of the embodiments, taken in conjunction with the accompanying drawings of which.

DETAILED DESCRIPTION OF THE INVENTION

Figure 1:
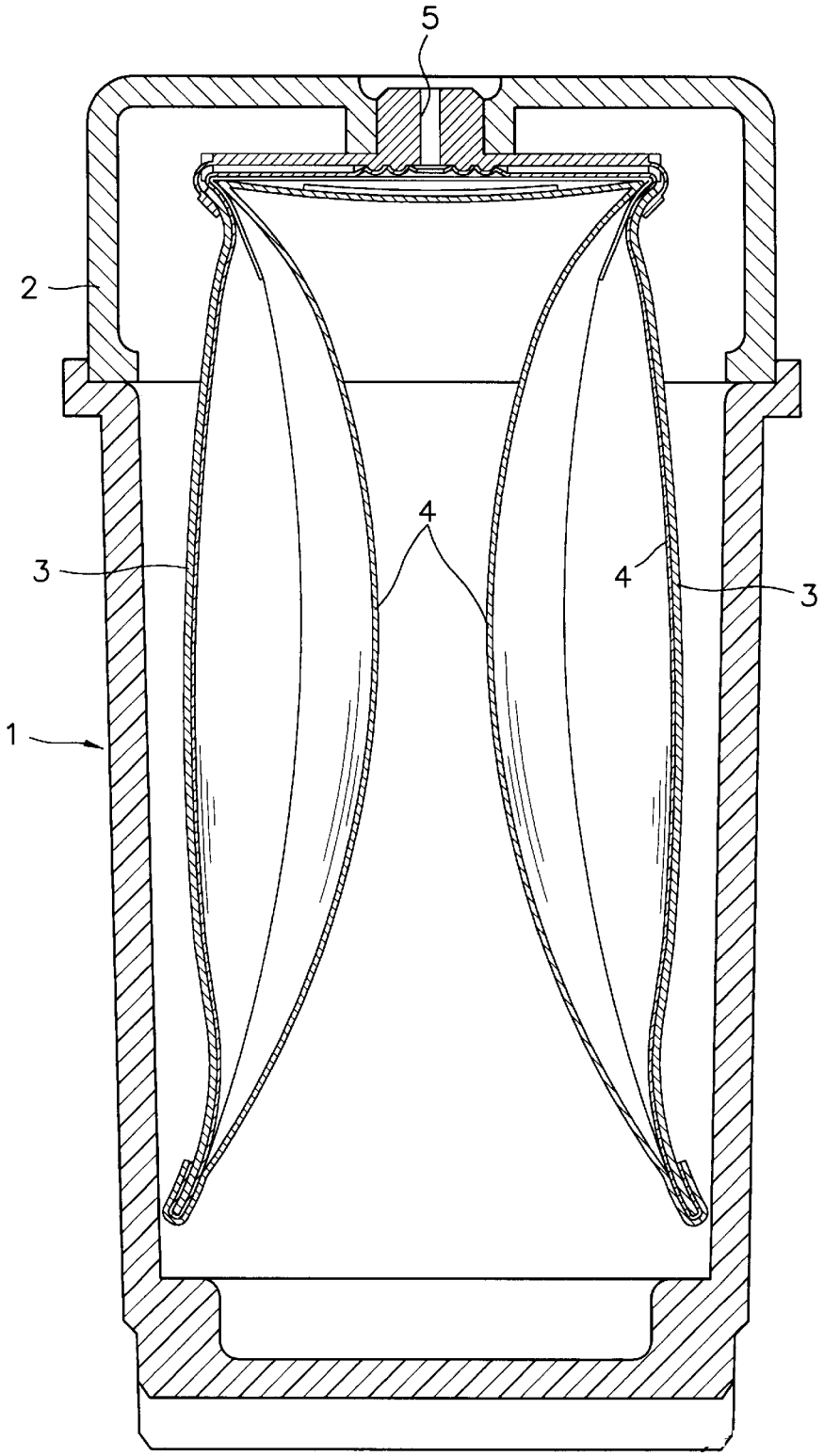
FIG.1 (PRIOR ART)
FIG. 1 is a cross-sectional view of a conventional ink cartridge.

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 2:
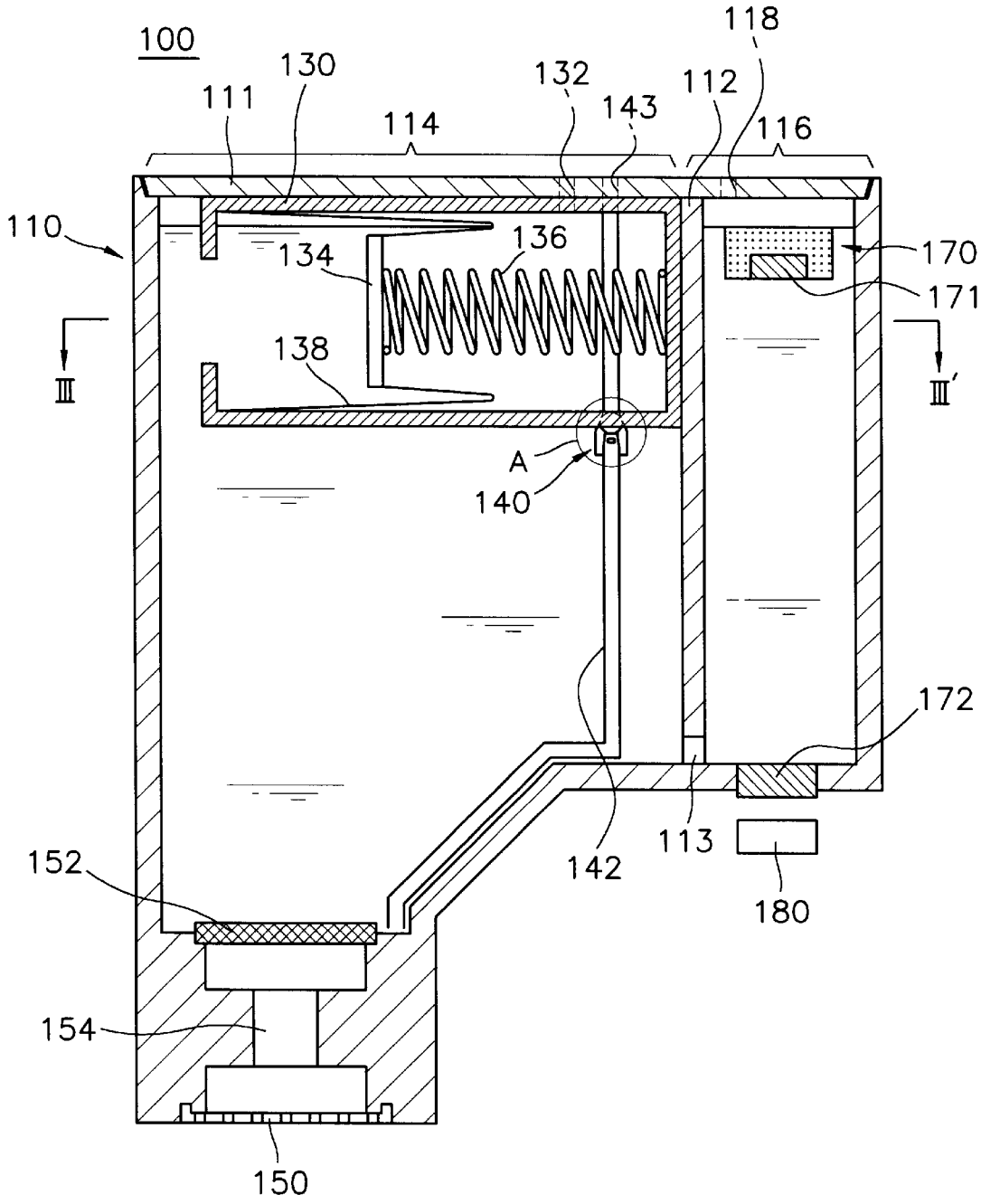
FIG. 2 is a cross-sectional side view of an ink cartridge with a pressure-controlling module according to an embodiment of the present invention.
Figure 3:
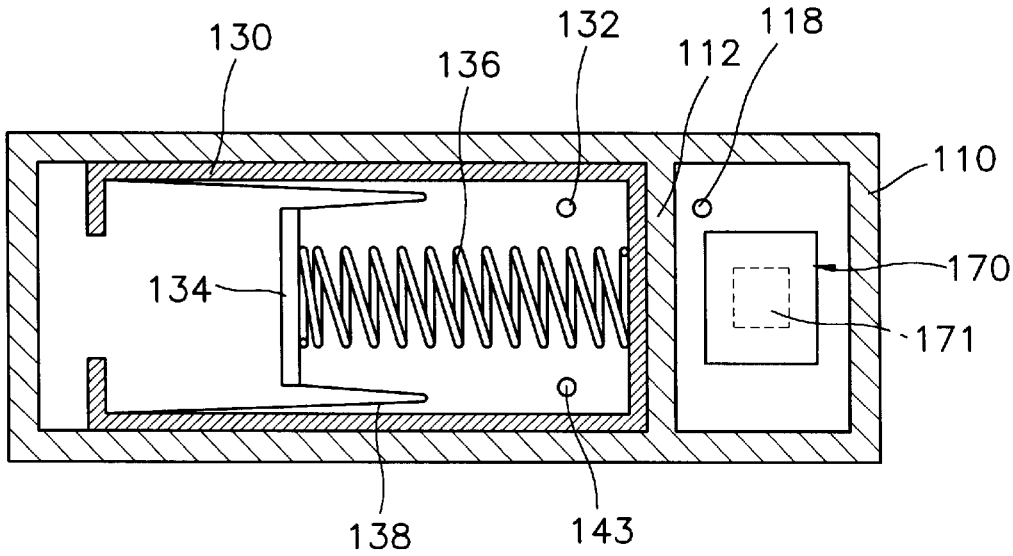
FIG. 3 is a cross-sectional view taken along line III–III' of FIG. 2.
Figure 4:
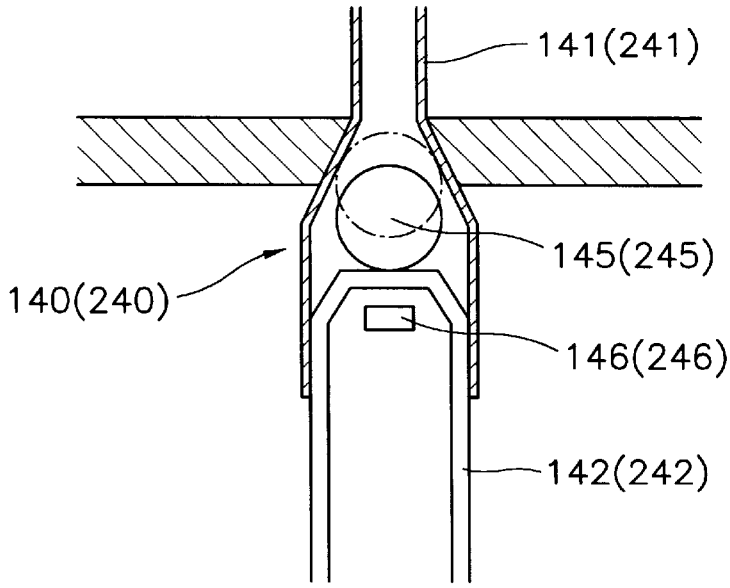
FIG. 4 is an enlarged view of a portion A of FIG. 2.

FIG. 2 is a cross-sectional side view of an ink cartridge with a pressure-controlling module according to an embodiment of the present invention, FIG. 3 is a cross-sectional view taken along line III–III' of FIG. 2, and FIG. 4 is an enlarged view of a portion A of FIG. 2.

Referring to FIGS. 2 and 3, an ink cartridge 100 includes an ink reservoir 110 in which ink is stored, a cover 111 to cover the ink reservoir 110, a pressure-controlling module 130 fixed under the cover 111, and a printhead 150 to eject ink in a droplet shape.

The ink reservoir 110 is divided into first and second chambers 114 and 116 via a barrier wall 112, which is provided perpendicular to the cover 111 inside the ink reservoir 110. An ink passage 113 is formed at the bottom of the barrier wall 112. Also, a plurality of holes (not shown) at the barrier wall 112 may be used as an ink passage between two chambers 114 and 116.

A filter 152, which filters impurities in the ink and fine bubbles and prevents an ejection hole of the printhead 150 from being clogged, is provided under the first chamber 114. An ink supply pipe 154 to supply the filtered ink to the printhead 150 is provided under the filter 152.

The pressure-controlling module 130 has a body having one opened side to provide communication with the ink reservoir 110. A guide plate 134 which is vertically placed and moves horizontally, a flexible wall 138 which is connected to the guide plate 134 and an opened side of the pressure-controlling module 130 and forms a movable boundary wall in the ink reservoir 110, while moving together with the movement of the guide plate 134, and a coil spring 136 that is connected to the guide plate 134 and a side facing the opened side of the pressure-controlling module 130, are provided in the pressure-controlling module 130. In addition, a vent hole 132, which penetrates the cover 111 and upper part of the pressure-controlling module 130 and communicates with ambient air, is formed at the upper part of the pressure-controlling module 130 separated from the ink reservoir 110 by the flexible wall 138.

In an aspect of the invention, the flexible wall 138 is formed of a vinyl sheet on which a metal thin film is formed so as to prevent ventilation, or a rubber bag.

Referring to FIG. 4 together with FIGS. 2 and 3, a check valve 140, which penetrates the pressure-controlling module 130, is installed in the first chamber 114. The check valve 140 includes a first pipe 141, a second pipe 142 connected to the lower end of the first pipe 141, and a floating ball 145 which is placed in a space formed between the first pipe 141 and the second pipe 142. An air inlet hole 143 is formed at the top end of the first pipe 141, the first pipe 141 penetrating the pressure-controlling module 130 and the cover 111. This hole 143 provides ambient air into the first chamber 114. The second pipe 142 is extended near the bottom of the ink reservoir 110. In addition, the top end of the second pipe 142 is blocked, and a hole 146 of air passage is formed at the side near the top end of the second pipe 142.

The second chamber 116 includes a magnet float 170 which floats into the ink filled in the second chamber 116, and a second magnet 172 fixed at the bottom of the chamber 116. The magnet float 170 is formed of foaming polypropylene resin, and the first magnet 171 is provided at the lower part of the magnet float 170. The first magnet 171 is a plastic magnet. An ink filling hole 118 is formed in the cover 111 which covers the upper portion of the second chamber 116. The ink filling hole 118 is sealed after the ink reservoir 110 is filled with ink.

A magnet sensor 180 is installed under the second magnet 172 at a predetermined distance. The magnet sensor 180 is a sensor which detects magnetic flux of more than a predetermined value. The magnet sensor 180 does not detect the magnetic flux of the second magnet 172 and detects only increased magnetic flux if the first magnet 171 contacts the second magnet 172.

In the present embodiment, a hall effect sensor, which is installed at about 4 mm under the second magnet 172 and detects magnetic flux of more than 500 gauss, is used as the magnet sensor 180. The hall effect sensor works by detecting the "S" pole of a magnet, and thus the "S" pole of the first and second magnets 171 and 172 is positioned facing downward. The magnetic flux of the first and second magnets 171 and 172 is 300 gauss, respectively. The value of the magnetic flux being detected by the sensor 180 varies with the separation distance of the magnet sensor 180 from the second magnet 172 and the distance between first and second magnets 171 and 172.

Figure 5:
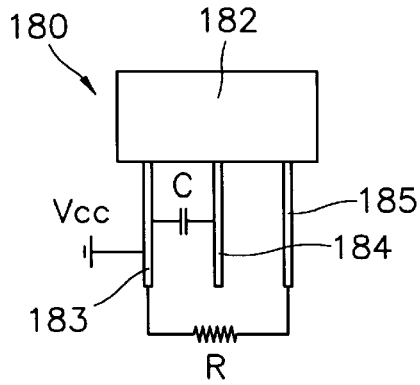
FIG. 5 illustrates an example of a hall effect sensor.

FIG. 5 illustrates an example of a hall effect sensor 180. Referring to FIG. 5, the hall effect sensor 180 includes a sensor portion 182 and three lead wires 183, 184, and 185. A 3.3V DC voltage is applied to the first lead wire 183 and the second lead wire 184 is grounded. The third lead wire 185 is an output line which outputs 3.3V when detected magnetic flux is more than a predetermined value by the sensor portion 182, and outputs 0V when the detected magnetic flux by the sensor portion 182 is less than the predetermined value.

The operation of the ink cartridge 100 having the above structure will be described with reference to the drawings.

The ink cartridge 100 of FIG. 2 is filled with ink through the ink filling hole 118 when the guide plate 134 is placed in a predetermined position of the pressure-controlling module 130 such that the ink reservoir 110 is maintained at a predetermined range of negative pressure. A method of generating a predetermined range of negative pressure at the ink reservoir 110 is as follows. When the guide plate 134 is placed near the opened side of the pressure-controlling module 130, ink fills the ink reservoir 110 through the ink filling hole 118 of the cover 111, the guide plate 134 is released, the guide plate 134 and the flexible wall 138 move in a direction opposite from the opened side of the pressure-controlling module 130 by a restoring force of the spring 136, and a vacuum is formed in the ink reservoir 110, thereby forming a predetermined range of negative pressure in the ink reservoir 110.

When the ink cartridge 100 is mounted on a printer (not shown), ink in the ink reservoir 110 is supplied to the printhead 150 through the filter 152 and the ink supply pipe 154 in printing. Therefore, ink in the first chamber 114 and the second chamber 116 decreases. Even if the guide plate 134 moves toward the opened side of the pressure-controlling module 130 with the dispensing of ink, the restoring force of the spring 136, applied to the guide plate 134 in the opposite direction from the opened side, maintains the ink reservoir 110 at a predetermined range of negative pressure.

In the meantime, when the printer on which the ink cartridge 100 is mounted is used under a low pressure like in an airplane, due to the volume expansion of the ink reservoir of the ink cartridge 110, ink would normally leak through the printhead 150. However, according to the embodiment of FIG. 2, the flexible wall 138 which forms a variable wall when the volume of the ink reservoir 110 increases, and the guide plate 134 which compresses the spring 136 in the opposite direction from the opened side of the pressure-controlling module 130, move in a direction where the volume of the ink reservoir 110 increases and absorbs a pressure increase. Thus, ink in the ink reservoir 110 is prevented from leaking through the printhead 150.

As the ink in the ink reservoir 110 is used, the guide plate 134 moves toward and eventually contacts the opened side of the pressure-controlling module 130. At this point, the pressure-controlling function of this guide plate 134 and the flexible wall 138 is complete.

When due to a further decrease of the volume of the ink reservoir 110, a difference between the pressure of the ink reservoir 110 and an atmospheric pressure increases, causing air flow into the ink reservoir 110 through the check valve 140 such that a vacuum volume is reduced, and thus the ink reservoir 110 is maintained at a predetermined range of negative pressure. In this case, the floating ball 145 of the check valve 140 is positioned on the top end of the second pipe 142, as shown in FIG. 4, such that the bottom end of the first pipe 141 is opened, and external air passing through the bottom end of the first pipe 141 flows into the ink reservoir 110 through the hole 146 formed at the side near the top end of the second pipe 142, thus reducing the negative pressure in the ink reservoir 110.

As the ink level of the second chamber 116 decreases, the magnet float 170 moves downward. Finally, when ink is exhausted, the first magnet 171 of the magnet float 170 contacts the second magnet 172, and thus increases magnetic flux. When the magnetic flux is increased over the predetermined value, the sensor portion 182 operates, and the magnet sensor 180 outputs 3.3V to an output portion of the third lead wire 185, indicating that the ink in the ink reservoir 100 is exhausted.

In addition, when the ink cartridge 100 is turned over while moving, the floating ball 145 is pushed toward the first pipe 141 by the ink passing through the hole 146 of the second pipe 142, as illustrated by the dotted line of FIG. 4, and thus the bottom end of the first pipe 141 becomes blocked by the floating ball 145. In most cases, a vacuum or air contacts the bottom end of the second pipe 142 near the bottom of the ink reservoir 110 when the ink cartridge 100 is turned over, an thus ink ejection is prevented.

Figure 6:
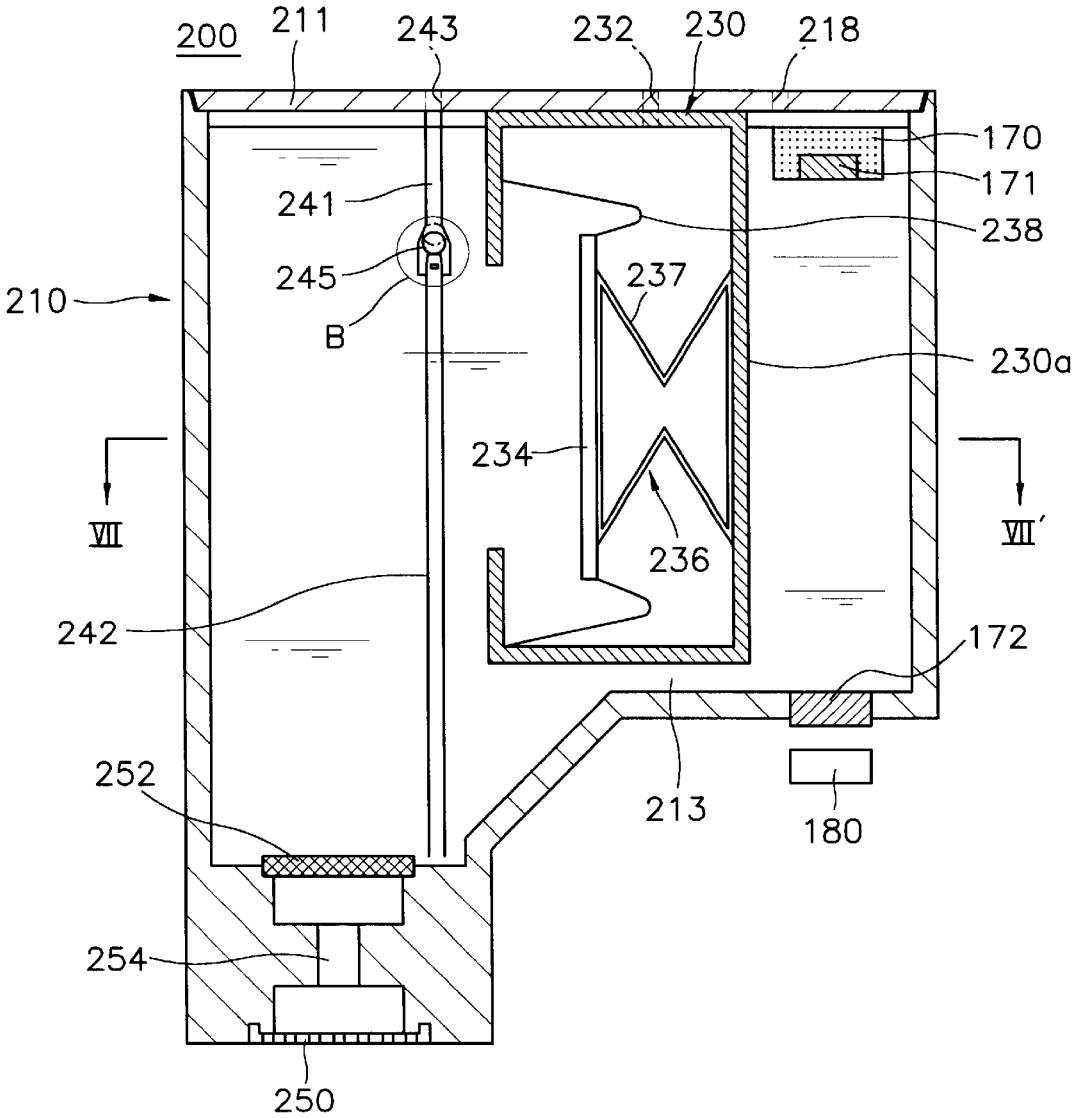
FIG. 6 is a cross-sectional side view of an ink cartridge with a pressure-controlling module according to another embodiment of the present invention.
Figure 7:
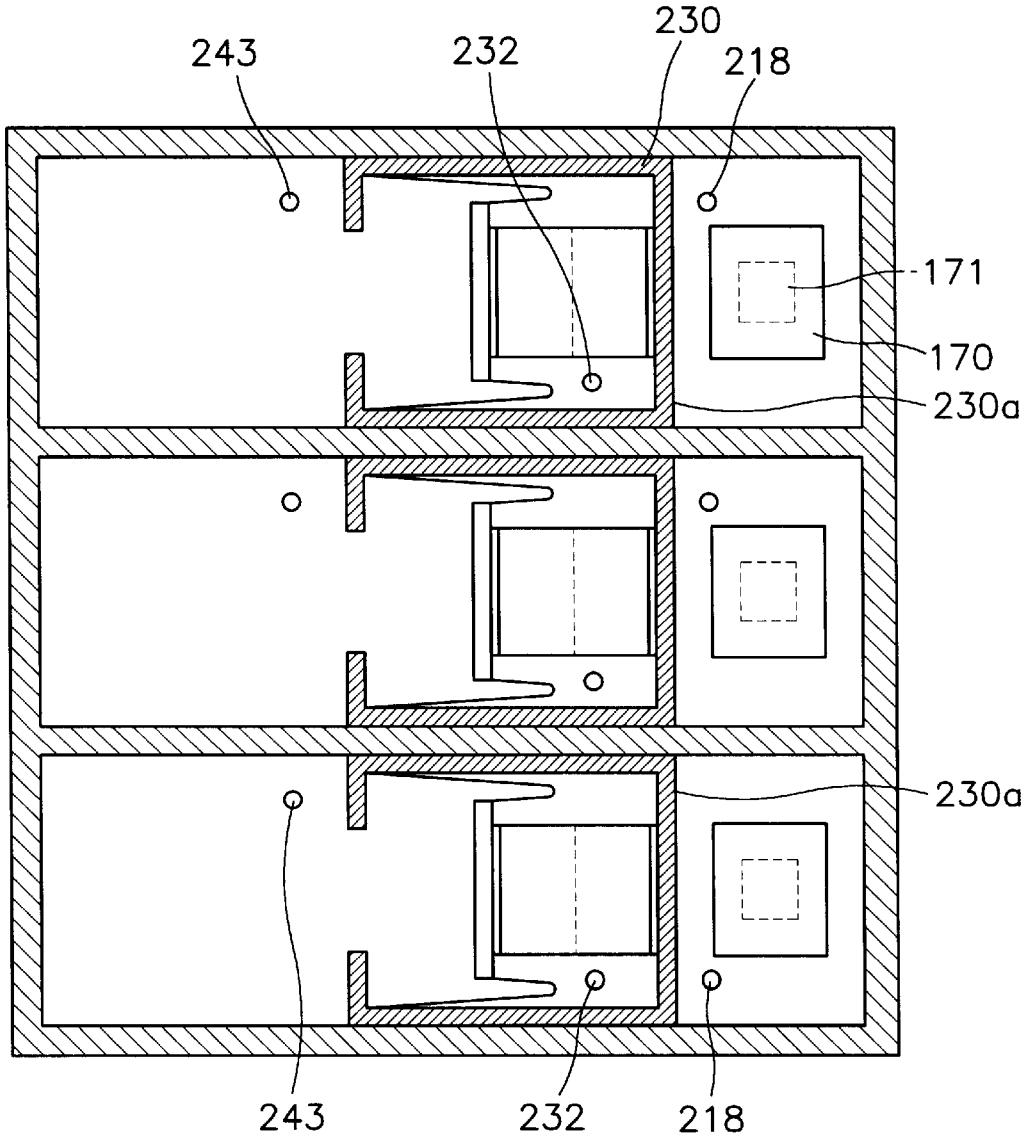
FIG. 7 is a cross-sectional view taken along line VII–VII' of FIG. 6.

FIG. 6 is a side view of an ink cartridge with a pressure-controlling module illustrating another embodiment of the present invention, and FIG. 7 is a cross-sectional view taken along line VII–VII' of FIG. 6, and illustrates a color ink cartridge comprising three ink cartridges. Like reference numerals refer to like elements throughout the drawings.

Referring to FIGS. 6 and 7, an ink cartridge 200 includes an ink reservoir 210 in which ink is stored, a cover 211 to cover the ink reservoir 210, a pressure-controlling module 230 fixed under the cover 211, and a printhead 250 to eject ink in a droplet shape.

The ink reservoir 210 is divided into two chambers by the pressure-controlling module 230. An ink passage 213 between the two chambers is formed at the bottom of the pressure-controlling module, and a side wall 230*a* of the pressure-controlling module 230 guides the vertical motion of a magnet float 170 which will be described later.

A filter 252 which filters impurities and fine bubbles in the ink reservoir 210 and prevents an ejection hole of the printhead 250 from being clogged is provided under the ink reservoir 210. An ink supply pipe 254 to supply the filtered ink to the printhead 250 is provided under the filter 252.

The pressure-controlling module 230 has a body having one opened side and thus communicates with the ink reservoir 210. A vent hole 232, which penetrates the cover 211 and upper part of the pressure-controlling module 230 to provide communication with ambient air, is formed at the upper part of the pressure-controlling module 230. A guide plate 234 vertically placed to move horizontally, a leaf spring 236 having one end connected to the guide plate 234 and the other end connected to the inside of the pressure-controlling module 230 facing the opened side thereof and having a spring connection portion 237 to connect both ends of the leaf spring 236 to each other, are provided in the pressure-controlling module 230. A flexible wall 238, which is connected to an edge of the guide plate 234 and the opened side of the pressure-controlling module 230 to form a movable boundary wall in the ink reservoir 210 while moving together with the guide plate 234, is further installed in the pressure-controlling module 230. In an aspect of the invention, a metal thin film is disposed on the flexible wall 238 so as to prevent ventilation.

Referring to FIG. 4, showing an enlarged view of a portion B of FIG. 6, a check valve 240 has a structure in which a first pipe 241 is connected to a second pipe 242 such that a predetermined space is formed between the first and second pipes 241 and 242, and a floating ball 245 is installed in the space. In addition, the top end of the second pipe 242 is blocked, and a hole 246 of an air passage is formed at the side near the top end of the second pipe 242. An air inlet hole 243 is formed at the top end of the first pipe 241 while the first pipe 241 penetrates the cover 211. This hole 243 provides ambient air into the ink reservoir 210. The second pipe 242 extends near the bottom of the ink reservoir 210.

Each ink cartridge for a different color, such as yellow, magenta, and cyan, includes a magnet float 170 which floats due to the ink filled in the chamber and contacts the side wall 230*a* of the pressure-controlling module, and a second magnet 172 fixed at the bottom of the chamber. Further, a first magnet 171 is provided at the lower part of the magnet float 170, and the first magnet 171 is preferably a plastic magnet so that the magnet float 170 floats in the ink. An ink filling hole 218 is formed at the cover 211 which covers the upper portion of the chamber. The ink filling hole 218 is sealed after the ink reservoir 210 is filled with ink.

A magnet sensor 180 is installed under the second magnet 172 at a predetermined distance. The magnet sensor 180 is a sensor which detects magnetic flux of more than a predetermined value. The magnet sensor 180 does not detect the magnetic flux of the second magnet 172, but detects only increased magnetic flux if the first magnet 171 contacts the second magnet 172.

The first magnet 171 may be designed such that the magnetic flux of the first magnet(s) 171 in a neighboring ink cartridge(s) does not hinder the first magnet 171 being moved downwardly with the ink level in the corresponding cartridge. In addition, when the first magnet 171 contacts the lower portion of the ink reservoir 210, the magnetic flux of the first magnet 171 should be detected by the magnet sensor 180 installed under the lower portion of the ink reservoir 210 at a predetermined distance. Thus, according to this embodiment, in order to prevent the inference from neighboring magnetic flux, magnetic flux which can be detected by the magnet sensor 180 is divided into the magnetic flux of the first magnet 171 and the second magnet 172. That is, the magnetic flux of the first magnet 171 is decreased, and the second magnet 172 having the decreased magnetic flux is installed at the bottom of the ink reservoir 210.

In the present embodiment, a hall effect sensor, which is installed at about 4 mm under the second magnet 172 and detects magnetic flux of more than 500 gauss, is used as the magnet sensor 180. The hall effect sensor works by detecting the "S" pole of a magnet, and thus the "S" pole of the first and second magnets 171 and 172 is positioned facing downward. The magnetic flux of the first and second magnets 171 and 172 is about 300 gauss, respectively. The value of the magnetic flux being detected by the sensor 180 varies with the separation distance of the magnet sensor 180 from the second magnet 172 and the distance between first and second magnets 171 and 172.

In the present embodiment, a combined ink cartridge having three color reservoirs is shown, but this embodiment could be applied to a one color ink cartridge in the alternative.

The operation of the ink cartridge 200 having the above structure will be described with reference to FIG. 7.

The ink cartridge 200 is filled with ink through the ink filling hole 218 when the guide plate 234 is placed in a predetermined position of the pressure-controlling module 230 such that the ink reservoir 210 is maintained at a predetermined range of negative pressure. Then, the ink cartridge 200 is mounted on a printer (not shown), and ink in the ink reservoir 210 is supplied to the printhead 250 through the filter 252 and the ink supply pipe 254 during printing. As a result, ink in the ink reservoir 210 decreases. Even if the guide plate 234 moves toward the opened side of the pressure-controlling module 230 during the dispensing of ink, the restoring force of the leaf spring 236, applied to the guide plate 234 in the opposite direction from the opened side, maintains the ink reservoir 210 at a predetermined range of negative pressure.

In the meantime, when the printer on which ink cartridge 200 is mounted is used under a low pressure such as an airplane, due to the volume expansion of the ink reservoir of the ink cartridge 200, the ink leaks through the printhead 250. However, according to the embodiment of FIG. 7, the flexible wall 238 which forms a variable wall when the volume of the ink reservoir 210 increases, and the guide plate 234 compressing the spring connection portion 237, move in a direction where the volume of the ink reservoir 210 is increased and absorbs a pressure increase. Thus, ink in the ink reservoir 210 is prevented from leaking through the printhead 250.

As the ink in the ink reservoir 210 is used, the guide plate 234 moves toward and eventually contacts the opened side of the pressure-controlling module 230. At this point, the pressure-controlling function of this guide plate 234 and the flexible wall 238 is complete.

When due to a further decrease of the volume of the ink reservoir 210, a difference between the pressure of the ink reservoir 210 and an atmospheric pressure increases, causing air flow into the ink reservoir 210 through the check valve 240 such that a vacuum volume is reduced, and thus the ink reservoir 210 is maintained at a predetermined range of negative pressure. In this case, the floating ball 245 of the check valve 240 is positioned on the top end of the second pipe 242, as shown in FIG. 4, such that the bottom end of the first pipe 241 is opened, and external air passing through the bottom end of the first pipe 241 flows into the ink reservoir 210 through the hole 246 formed at the side near the top end of the second pipe 242, thus reducing the negative pressure in the ink reservoir 210.

As the ink level of the ink reservoir 210 decreases, the magnet float 170 moves downward. Finally, when ink is exhausted, the first magnet 171 of the magnet float 170 contacts the second magnet 172, and thus increases magnetic flux. When the magnetic flux is increased over the predetermined value, the sensor portion 182 operates, and the magnet sensor 180 outputs 3.3V to an output portion of the third lead wire 185, indicating that the ink in the ink cartridge 200 is exhausted.

In addition, when the ink cartridge 200 is turned over while moving, the floating ball 245 is pushed toward the first pipe 241 by the ink passing through the hole 243 of the second pipe 242, as illustrated by the dotted line in FIG. 4 and thus the bottom end of the first pipe 241 becomes blocked by the floating ball 245. In most cases, a vacuum or air contacts the bottom end of the second pipe 242 near the bottom of the ink reservoir 210 when the ink cartridge 200 is turned over, and thus ink ejection is prevented.

As described above, the ink cartridge with the pressure-controlling module according to the embodiment of the present invention includes a pressure-controlling module having a compact structure, and thus is easily employed in a newly designed ink cartridge having a new structure, in particular, a small color ink cartridge.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An ink cartridge with a pressure-controlling module, the ink cartridge comprising:

an ink reservoir in which ink is stored;

a printhead through which ink from the ink reservoir is ejected onto a printing medium in a droplet shape; and a pressure-controlling module which is placed in the ink reservoir, by which the ink reservoir is maintained at a predetermined range of negative pressure, and in which a buffer volume to accommodate a rapid volume expansion of the ink reservoir is prepared, the pressure-controlling module comprising:

a body having one opened side to communicate with the ink reservoir, a guide plate placed vertically in the body and moves horizontally according to a pressure variations of the ink reservoir such that the ink reservoir is maintained at predetermined range of negative pressure, a flexible wall through which the guide plate and the opened side of the body are connected to be sealed and which forms a variable wall depending on the movement of the guide plate, a spring which connects the guide plate to a side of the body facing the opened side, and a vent hole to communicate a space, which is separate from the ink reservoir by the flexible wall, with ambient air.

2. The ink cartridge of claim 1, further comprising a check valve installed in the ink cartridge, supplies ambient air to the ink cartridge and prevents leakage of the ink from the ink reservoir.

3. The ink cartridge of claim 2, wherein the check valve has one end connected to the outside and the other end adjacent to the bottom of the ink reservoir.

4. The ink cartridge of claim 1, wherein the spring is a coil spring.

5. The ink cartridge of claim 1, wherein the spring is a leaf spring.

6. The ink cartridge of claim 1, further comprising:

a magnet float which floats within ink in a chamber, the chamber being partially separated from the pressure-controlling module through a vertical barrier wall having an ink passage to communicate ink through the ink reservoir and including a first magnet at the lower part of the first magnet float;

a second magnet provided at the bottom of the first chamber; and a magnet sensor placed under the second magnet at a predetermined distance and which detects the increased magnetic flux due to the combination of the magnet float and the second magnet.

7. The ink cartridge of claim 6, wherein the magnet float is formed of foaming polypropylene resin.

8. The ink cartridge of claim 6, wherein the first magnet is a plastic magnet.

9. The ink cartridge of claim 6, wherein the magnet sensor is a hall effect sensor which outputs a detection signal when magnetic flux of more than a predetermine value is detected.

10. The ink cartridge of claim 1, further comprising:

a chamber formed by the side of the ink cartridge facing the opened side of the pressure-controlling module;

a magnet float which floats within ink in the chamber, the ink passes under the pressure-controlling module, the magnetic float including a first magnet at the lower part of the first magnet float;

a second magnet provided at the bottom of the chamber; and a magnet sensor placed under the second magnet at a predetermined distance and which detects the increased magnetic flux due to the combination of the magnet float and the second magnet.

11. The ink cartridge of claim 10, wherein the magnet float is formed of foaming polypropylene resin.

12. The ink cartridge of claim 10, wherein the first magnet is a plastic magnet.

13. The ink cartridge of claim 10, wherein the magnet sensor is a hall effect sensor which outputs a detection signal when magnetic flux of more than a predetermined value is detected.

14. A color ink cartridge with a pressure-controlling module which comprises a plurality of ink reservoirs each of which is filled with a predetermined color of ink, each ink reservoir comprising:

a printhead through which ink of the ink reservoir is ejected onto a printing medium in a droplet shape; and a pressure-controlling module for said each ink reservoir which is placed in the ink reservoir, by which the ink reservoir is maintained at a predetermined range of negative pressure, and in which a buffer volume to accommodate a rapid volume expansion of the ink reservoir is prepared, each pressure-controlling module comprising:

a body having one opened side to communicate with the ink reservoir, a guide plate placed vertically in the body and moves horizontally according to a pressure variations of the ink reservoir such that the ink reservoir is maintained at predetermined range of negative pressure, a flexible wall through which the guide plate and the opened side of the body are connected to be sealed and which forms a variable wall depending on the movement of the guide plate, a spring which connects the guide plate to a side of the body facing the opened side, and a vent hole to communicate a space, which is separate from the ink reservoir by the flexible wall, with ambient air.

15. The color ink cartridge of claim 14, further comprising a check valve which is installed in the ink cartridge, supplies ambient air to the ink cartridge and prevents leakage of the ink from the ink reservoir.

16. The color ink cartridge of claim 15, wherein the check valve has one end connected to the outside and the other end adjacent to the bottom of the ink reservoir.

17. The color ink cartridge of claim 14, wherein the spring is a coil spring.

18. The color ink cartridge of claim 14, wherein the spring is a leaf spring.

19. The color ink cartridge of claim 14, further comprising:

a chamber partially separated from the pressure-controlling module through a vertical barrier wall having an ink passage to communicate ink through the ink reservoir;

a magnet float which floats within ink in the chamber, the magnetic float including a first magnet positioned at the lower part thereof;

a second magnet provided at the bottom of the chamber; and a magnet sensor placed under the second magnet at a predetermined distance and which detects the increased magnetic flux due to the combination of the magnet float and the second magnet.

20. The color ink cartridge of claim 19, wherein the magnet float is formed of foaming polypropylene resin.

21. The color ink cartridge of claim 19, wherein the first magnet is a plastic magnet.

22. The color ink cartridge of claim 19, wherein the magnet sensor is a hall effect sensor which outputs a detection signal when magnetic flux of more than a predetermined value is detected.

23. The color ink cartridge of claim 14, further comprising:

a chamber formed by the side of the ink cartridge facing the opened side of the pressure-controlling module such that the ink passes under the pressure-controlling module to the chamber;

a magnet float which floats within ink in the chamber, the magnetic float including a first magnet at the lower part thereof;

a second magnet provided at the bottom of the chamber; and a magnet sensor placed under the second magnet at a predetermined distance and which detects the increased magnetic flux due to the combination of the magnet float and the second magnet.

24. The color ink cartridge of claim 23, wherein the magnet float is formed of foaming polypropylene resin.

25. The color ink cartridge of claim 23, wherein the first magnet is a plastic magnet.

26. The ink cartridge of claim 23, wherein the magnet sensor is a hall effect sensor which outputs a detection signal when magnetic flux of more than a predetermine value is detected.

* * * * *

UNITED STATES PATENT AND TRADEMARK OFFICE

CERTIFICATE OF CORRECTION

PATENT NO. : 6,739,712 B2
DATED : May 25, 2004
INVENTOR(S) : Jeong-seon Kim

It is certified that error appears in the above-identified patent and that said Letters Patent is hereby corrected as shown below:

Title page,
Item 57, ABSTRACT,
Line 20, change “form” to -- from --.

Column 8,
Line 42, delete “a” before “pressure”.
Line 42, insert -- the -- before “predetermined”.

Column 9,
Line 55, delete “a” before “pressure”.
Line 57, insert -- the -- before “predetermined”.

Signed and Sealed this

Thirty-first Day of August, 2004

JON W. DUDAS
*Director of the United States Patent and Trademark Office*